US005934948A

United States Patent [19]

Hiramatsu et al.

[11] Patent Number: 5,934,948

[45] Date of Patent: Aug. 10, 1999

[54] TERMINAL DEVICE FOR ELECTRIC EQUIPMENT

[75] Inventors: Etsuya Hiramatsu; Takato Hirota; Katsumi Shibata; Makoto Kawasaki, all of Saitama, Japan

[73] Assignee: Fuji Electric Co., Ltd., Kawasaki, Japan

[21] Appl. No.: 08/915,714

[22] Filed: Aug. 21, 1997

[30] Foreign Application Priority Data

Aug. 22, 1996 [JP] Japan ..... 8-220831

[51] Int. Cl.[6] ..... H01R 4/44

[52] U.S. Cl. ..... 439/781; 439/883; 439/810

[58] Field of Search ..... 439/727, 781, 439/782, 801, 810–812, 883

[56] References Cited

U.S. PATENT DOCUMENTS 5,595,512 1/1997 Langdon ..... 439/812
5,645,457 7/1997 Hirayama et al. ..... 439/801

FOREIGN PATENT DOCUMENTS 3-7028 2/1991 Japan .
6-68312 9/1994 Japan .

*Primary Examiner*—Khiem Nguyen
*Attorney, Agent, or Firm*—Kanesaka & Takeuchi

[57] ABSTRACT

A terminal device for an electric equipment is formed of a frame having a terminal housing, a fixed terminal situated in the terminal housing, and a terminal screw having a male screw to be coupled to a tapped hole of the fixed terminal and an inverse L-shaped washer. The inverse L-shaped washer includes one side for rotatably holding the male screw and a guide plate section bent relative to the one side. A guide groove is formed in the terminal housing for receiving the guide plate section therein to vertically guide the same. Also, the terminal device includes an engagement section having a first engaging part formed on the guide plate section and a second engaging part formed at a portion facing the guide groove and engaging the first engaging part to temporarily hold the guide plate section in the guide groove. Thus, the terminal screw can be held directly above the tapped hole, which enables the male screw to be stably and easily inserted into the tapped hole, and which facilitates simple rewiring.

6 Claims, 7 Drawing Sheets

TERMINAL DEVICE FOR ELECTRIC EQUIPMENT

BACKGROUND OF THE INVENTION AND RELATED ART STATEMENT

The present invention relates to a terminal device for an electric equipment that enables the terminal of a conductive material, such as a round terminal, to be connected easily without removing a terminal screw from a fixed terminal plate.

In general, in a terminal device for electric connection incorporated in an electric equipment, such as an electromagnetic contactor or switch, an end of a wiring is inserted between a fixed terminal plate with a tapped hole and a washer loosely supported by a male screw coupled to the fixed terminal plate, and the male screw is then tightened to connect the wiring to the electric equipment. When an electric wire having a round terminal with a round hole is connected to the terminal device, the male screw must be removed from the fixed terminal plate, and the male screw must be entered into the hole in the round terminal before the male screw is screwed into a tapped hole in the fixed terminal plate. This operation requires time to remove the male screw from the fixed terminal plate and involves mistakes, such as inadvertent dropping of the male screw, which requires more time to look for and pick up the dropped male screw, resulting in a degraded efficiency in the connecting operation. Thus, the terminal device for the electric equipment which improves efficiency in the connecting operation has been proposed.

FIG. 9 is a typical cross sectional view of a main part of a terminal device for an electric equipment with improved efficiency in the connecting operation, which is described in Japanese Patent Application Laid-Open(KOKAI) No. 60-130068. In this figure, a fixed terminal 13 fixed to a frame of the terminal device and formed of an insulating material includes a tapped hole 13*a*, and a male screw 12 to be coupled to the tapped hole 13*a* includes a washer 12*a* loosely and rotatably supported at a reduced diameter portion close to the head. A round hole 11*h*, into which a driver used to tighten or loosen the male screw 12 is inserted, is formed in a terminal cover 11 which covers the terminal device from above for preventing an electric shock. Furthermore, a flexible holding piece 11*a* engaging the bottom surface of the head of the male screw 12 to support the screw 12 is formed at the bottom of the round hole 11*h*. The terminal device is shipped with a gap maintained between the tip of the male screw 12 and the tapped hole 13*a*. At the time of connection, the round hole in the round terminal is fitted with the tip of the male screw 12 without loosening the screw as described above, and then the male screw 12 is pressed down and tightened.

FIG. 10 is a front view of a main part of a terminal device showing a different conventional example described in Japanese Patent Publication (KOKOKU) No. 4-4707, and FIGS. 11(*a*) and 11(*b*) are side views showing the shape of this terminal screw. In these figures, the terminal device comprises a fixed terminal 17 having a tapped hole 17*a* fixed to a frame 21 of an insulating member; and a terminal screw formed of a male screw 16 to be coupled to the tapped hole 17*a* and an inverse L-shaped washer 15 loosely and movably supported by the small diameter portion close to the head of the male screw.

The inverse L-shaped washer 15 has an inverse L shape and comprises a washer section penetrated by the male screw and a vertical portion with a bent portion 15*a* formed at the lower end of the vertical portion as shown in FIG. 11(*b*). The vertical portion is engaged with a guide groove 21*a* formed on the frame 21 side to vertically guide the male screw 16, thereby enabling the male screw 16 to be easily screwed into and removed from the tapped hole 17*a* in the fixed terminal 17. A plate spring 18 is installed at a bottom of the fixed terminal 17, and when the tip of the plate spring 18 is engaged with the bent portion 15*a* of the inverse L-shaped washer 15, the tip of the male screw 16 is separated from the tapped hole 17*a* and is held thereat. In this condition, a terminal 31 is placed around the tip of the male screw 16, and is then pressed down and tightened. In this manner, an electric wire can be connected without loosening the male screw 16.

In the terminal device in FIG. 9, when the male screw is tightened, the direction of the tip of the male screw is not stable in case the male screw is removed from the holding piece. This prevents the tip of the male screw from being easily screwed into the tapped hole 13*a* in the fixed terminal. In addition, if the electric wire is pulled when the male screw is inserted into the round hole in the round terminal, the male screw may slip from the holding piece. Furthermore, during the installation or removal of the wiring or during the additional connection of a round terminal, the terminal cover must be removed to thereby complicate the operation.

Although the terminal device in FIG. 10 reduces the number of the wiring steps and prevents a screw from being lost, it uses the plate spring to hold the inverse L-shaped washer in the upper part, resulting in an increased number of parts. In addition, the vertical portion of the inverse L-shaped washer can not be moved in a direction perpendicular to the direction of the sheet of the drawing due to the guide groove 21*a* of the frame 21. Therefore, when electric wires with different diameters are simultaneously connected on both sides of the male screw, normal tightening force does not allow the washer to be inclined, to thereby prevent a sufficient tightening force from being applied to the thinner electric wire. Furthermore, if a single wire is inserted on one side of the terminal screw and the screw is then tightened strongly, the connection between the washer section and vertical portion of the inverse L-shaped washer may be deformed to thereby make it impossible to reuse the device.

It is an object of the invention to provide a terminal device for an electric equipment that can reliably guide a male screw to a tapped hole in a fixed terminal without increasing the number of required parts and can certainly execute parallel connection of the electric wires with different diameters.

SUMMARY OF THE INVENTION

The invention provides a terminal device for an electric equipment for connecting a round terminal to a fixed terminal with a tapped hole, which is fixed to a terminal housing section in a frame partitioned by insulating walls. In a first aspect of the invention, the terminal device comprises a terminal screw formed of a male screw whose tip is coupled to the tapped hole and an inverse L-shaped washer rotatably held by the male screw and including a guide plate section bent at one side toward the fixed terminal.

In the terminal device, a guide groove is formed in the terminal housing section, and the guide plate section of the inverse L-shaped washer is inserted therein to guide and allow vertical movement of the guide plate section. In the condition that the tip of the male screw is coupled to the fixed terminal, the guiding of the guide plate section is released. An engagement section is formed both in the guide plate section of the inverse L-shaped washer and on the guide groove side in order to hold the guide plate section such that a constant gap is maintained between the tip of the male screw and the fixed terminal.

In a second aspect of the invention, the guide plate section of the inverse L-shaped washer has a thick portion in the middle and a thin portion on both sides thereof. Also, the guide groove comprises a vertical groove for guiding the thin portion in the longitudinal or vertical direction thereof, and a guide wall that guides the width direction of the thick portion, i.e. laterally.

In a third aspect of the invention, the guide groove is formed of a vertical groove that guides the thickness and width directions of the guide plate section of the inverse L-shaped washer.

In a fourth aspect of the invention, a notch is formed in the terminal housing section, and the engagement section on the guide groove side is formed in a flexible piece fitted in the notch.

In a fifth aspect of the invention, the terminal device is formed according to the fourth aspect, and includes a cover mounted on the frame, wherein the flexible piece is provided at the cover.

BRIEF DESCRIPTION OF THE DRAWINGS

FIG. 5(*b*) shows that a terminal screw is pressed down; and FIG. 5(*c*) shows that the connection of the round terminal is completed;

FIG. 6(*b*) shows that only the inverse L-shaped washer is inserted;

FIG. 7(*b*) shows that only the inverse L-shaped washer is inserted;

FIG. 8(*b*) is a perspective view of a terminal screw of another embodiment;

FIG. 11(*b*) is a side view thereof.

DETAILED DESCRIPTION OF PREFERRED EMBODIMENTS

The embodiments of the invention are shown in FIGS. 1 to 8(*b*), and are described below.

Figure 3:
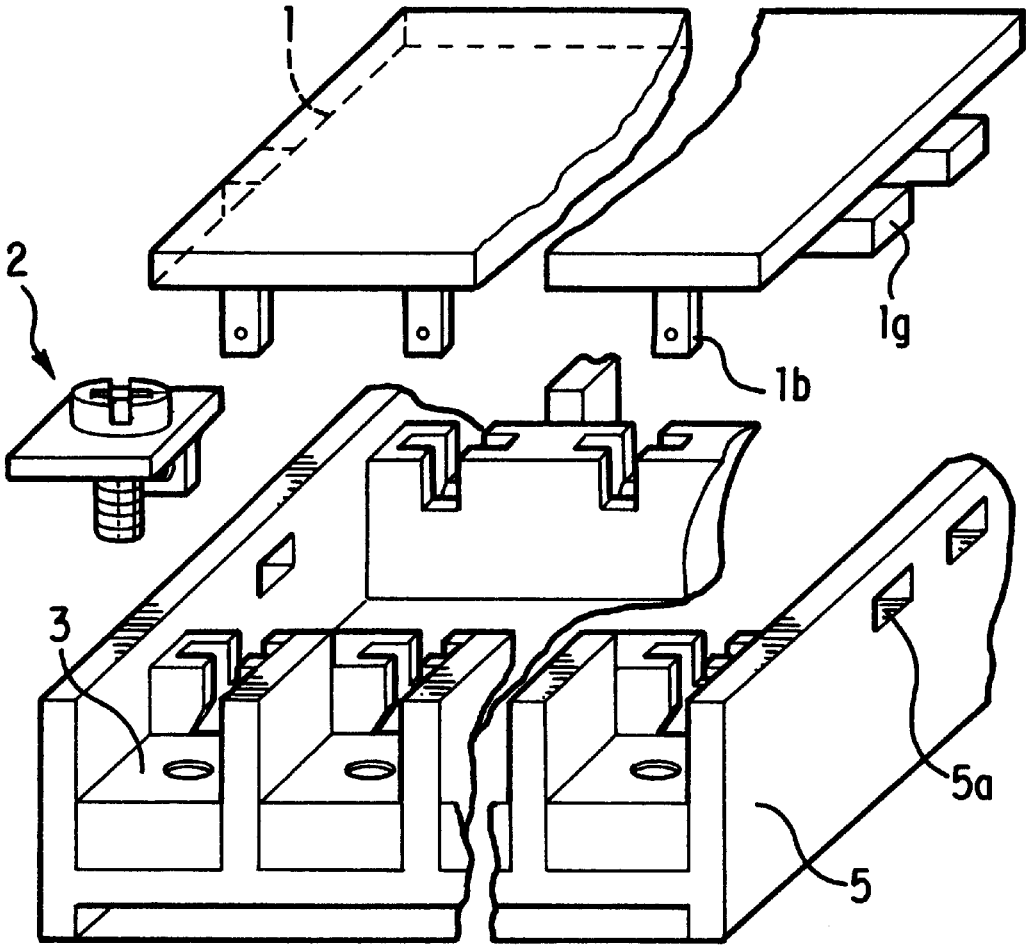
FIG. 3 is an exploded perspective view of a terminal device illustrating one embodiment of the invention.

FIG. 3 is an exploded perspective view of a terminal device for an electric equipment showing one embodiment of this invention. This terminal device comprises a plurality of terminal housing sections 3 partitioned by insulating walls; a frame 5 with engagement holes 5*a* in the side walls; a terminal screw 2 to be mounted in the terminal housing section 3 of the frame 5; and a cover 1 having claws 1*g* engaging the engagement holes 5*a* and flexible pieces 1*b* protruding toward the terminal housing sections 3. The cover 1 is mounted on the frame 5 by engaging the claws 1*g* with the engagement holes 5*a* of the frame 5. A fixed terminal with a tapped hole is fixed to the terminal housing section 3.

Figure 1:
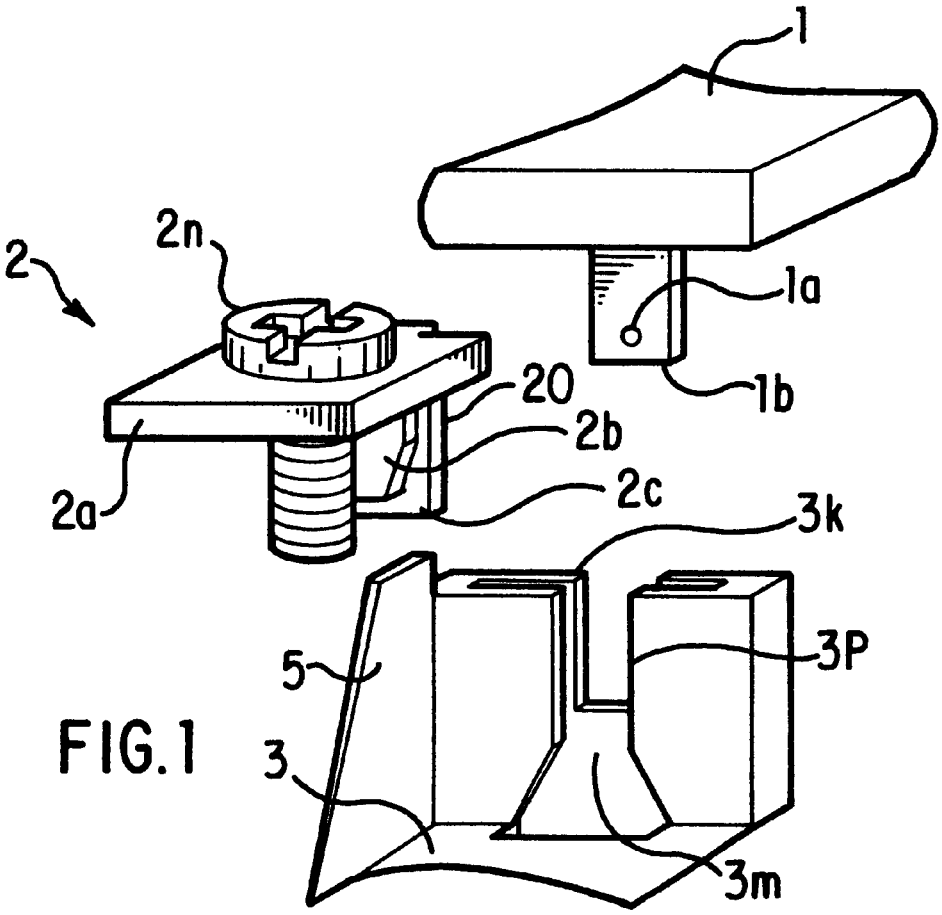
FIG. 1 is an exploded perspective view of a terminal device illustrating one embodiment of the invention.
Figure 2:
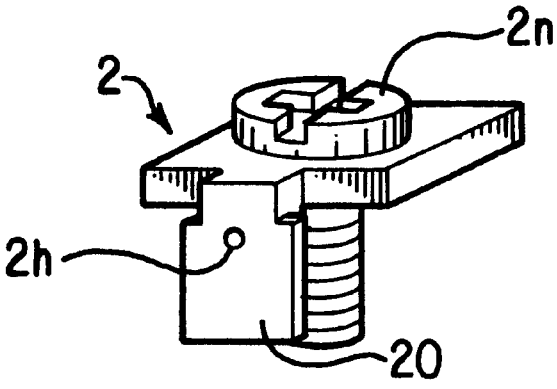
FIG. 2 is a perspective view for showing a terminal screw in FIG. 1.

FIG. 1 is a partially enlarged perspective view of FIG. 3 showing the structure of a part of the invention, and FIG. 2 is a perspective view showing the terminal screw 2 in FIG. 1. In the figures, the terminal screw 2 comprises a male screw 2*n* having a spring washer (not shown); and an inverse L-shaped washer 2*a* including a guide plate section 20 having a thick portion 2*b* in the middle and thin portions 2*c* on both sides thereof, which is formed by, for example, pressing, and a horizontal portion where the male screw 2*n* passes. The male screw 2*n* is rotatably attached to the inverse L-shaped washer 2*a*. In addition, a circular recessed portion or engagement section 2*h* is formed on a rear surface of the guide plate section 20 (FIG. 2), and a circular protruding portion or an engagement section la engaging the recessed portion 2*h* of the guide plate section 20 is formed on a flexible piece 1*b* of the cover 1. The positions of the recessed portion 2*h* formed on the guide plate section 20 and the protruding portion 1*a* formed on the flexible piece 1*b* of the cover 1 are set in such a way that when they are fitted together, a gap is maintained between the tip of the male screw of the terminal screw and the fixed terminal.

Furthermore, the terminal housing section 3 includes a guide groove 3*m*, into which the guide plate section 20 of the inverse L-shaped washer 2*a* is inserted to guide the vertical movement of the guide plate section 20; and a notch 3*k* in which the flexible piece 1*b* of the cover 1 is fitted. The guide groove 3*m* comprises a vertical groove for guiding the thinner portion 2*c* of the guide plate section 20 of the inverse L-shaped washer; and a guide wall 3*p* that guides the width or lateral direction of the thicker portion 2*b*. An upwardly tapered portion that is wider than the thick portion 2*b* is formed in the lower part of the guide wall 3*p*, so that guiding of the guide plate portion 20 is released at a position where the electric wire is pressed onto the inverse L-shaped washer.

In this structure, in order to mount the terminal screw 2 in the terminal housing section 3, the flexible piece 1*b* of the cover 1 is fitted in the notch 3*k* in the terminal housing section 3 in such a way that the protruding portion la of the flexible piece 1*b* is located inside the guide groove 3*m*. The guide plate section 20 of the inverse L-shaped washer 2*a* of the terminal screw 2 is then inserted into the guide groove 3*m* of the terminal housing section 3 from above, and the thin and thick portions 2*c* and 2*b* of the guide plate section 20 are pressed down along the vertical groove of the guide groove 3*m* and the guide wall 3*p*, respectively. Thus, the recessed portion 2*h* of the guide plate section 20 is fitted with the protruding portion 1*a* of the flexible piece 1*b*.

Figure 4:
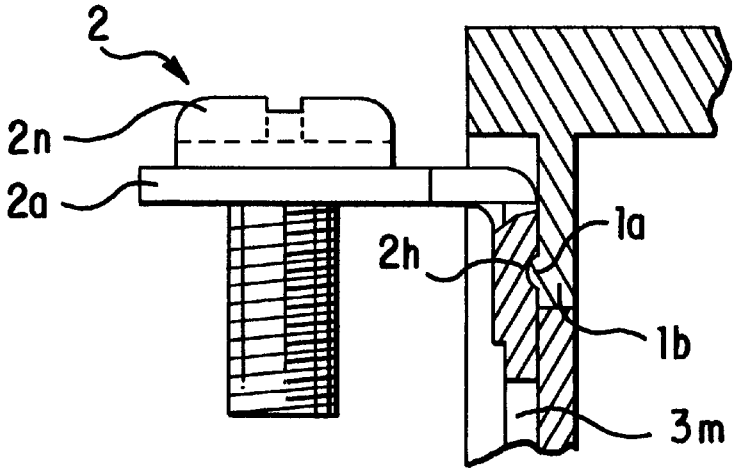
FIG. 4 is a partial cross sectional view of the terminal device in a fitted state according to the invention.

FIG. 4 is a side view showing a partial cross section of the terminal device in the fitted state. While the recessed portion 2*h* in the inverse L-shaped washer 2*a* of the terminal screw 2 is fitted to the protruding portion 1*a* of the flexible piece 1*b*, a gap is maintained between the tip of the male screw 2*n* of the terminal screw 2 and a fixed terminal (not shown). The device is shipped to the customers in this condition.

Figure 5A:
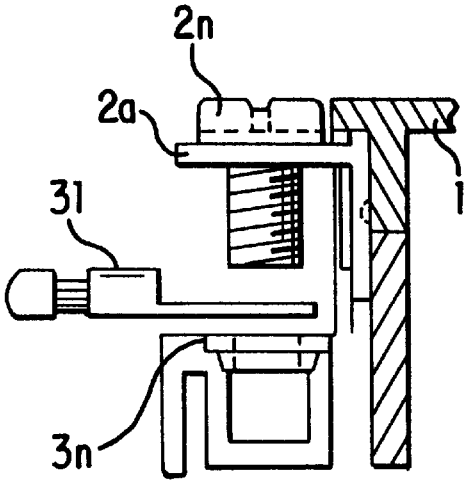
FIGS. 5(*a*)–5(*c*) are cross sectional views showing how a round terminal is connected to the terminal device, wherein FIG. 5(*a*) shows that the round terminal is inserted.
Figure 5B:
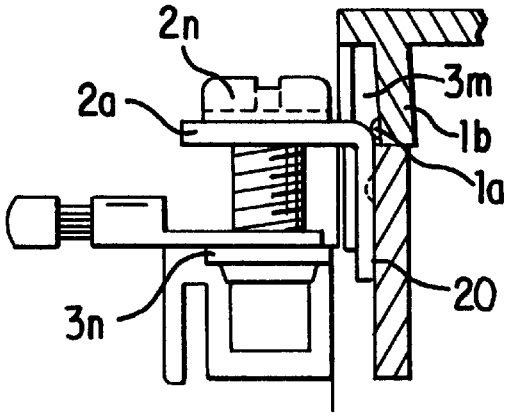
Figure 5C:
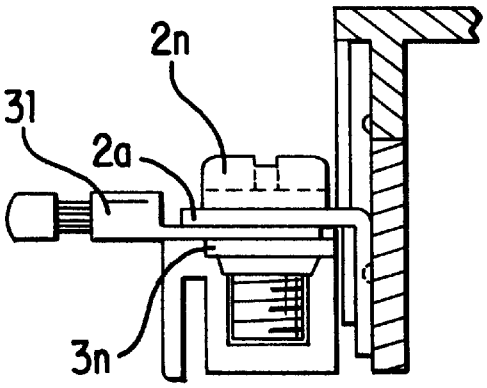

FIGS. 5(*a*) to 5(*c*) are cross sectional views for showing how a round terminal with a wiring is connected to the terminal device according to this invention. FIG. 5(*a*) shows that the round terminal is inserted; FIG. 5(*b*) shows that the terminal screw is pressed down; and FIG. 5(*c*) shows that the connection of the round terminal is completed.

First, a round terminal 31 is inserted between the tip of the male screw 2*n* as shown in FIG. 4 and the fixed terminal 3*n* (FIG. 5(*a*)). When the head of the male screw 2*n* is pressed down by using a driver, the engagement between the recessed portion of the guide plate section 20 and the protruding portion 1*a* of the flexible piece 1*b* is released, and the guide plate section 20 is moved downward along the guide groove 3*m* while the flexible piece 1*b* is flexed. Thus, the tip of the male screw 2*n* is guided toward a tapped hole in the fixed terminal 3*n* (FIG. 5(*b*)). In this condition, the protruding portion 1*a* of the flexible piece 1*b* contacts the bent portion of the inverse L-shaped washer, so that the terminal screw 2 is not raised unless force is applied in the direction opposite to the direction in which the male screw is being tightened. Thus, there is no gap between the tip of the male screw 2*n* and the fixed terminal 3*n*, and this enables the round terminal 31 to be temporarily fixed. If the male screw 2*n* is tightened further, the round terminal 31 is pressed and fixed between the fixed terminal 3*n* and the inverse L-washer 2*a* (FIG. 5(*c*)).

If, in the condition of FIG. 5(*c*) in which the connection has been completed, the wiring must be changed and the round terminal 31 must be removed, the male screw 2*n* is loosened, and the tip of the horizontal portion of the inverse L-shaped washer is raised from below by using a tool, such as a driver, to move up to a position at which the recessed portion in the guide plate section 20 is engaged with the protruding portion of the flexible piece 1*b*, as shown in FIG. 5(*a*). The round terminal can then be removed.

Figure 6A:
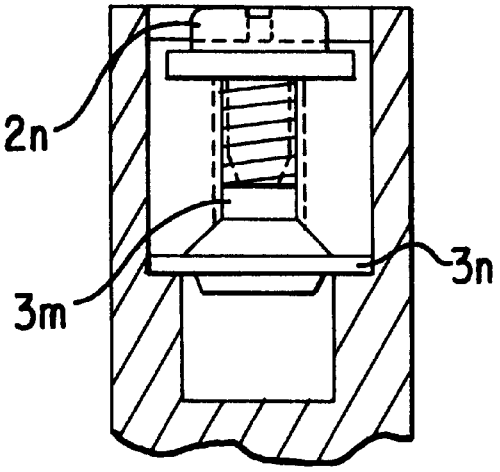
FIGS. 6(*a*) and 6(*b*) are cross sectional views of a main part of the terminal device when the terminal screw is retained as shown in FIG. 5 (*a*), wherein FIG. 6(*a*) shows that an inverse L-shaped washer with a male screw is inserted.
Figure 6B:
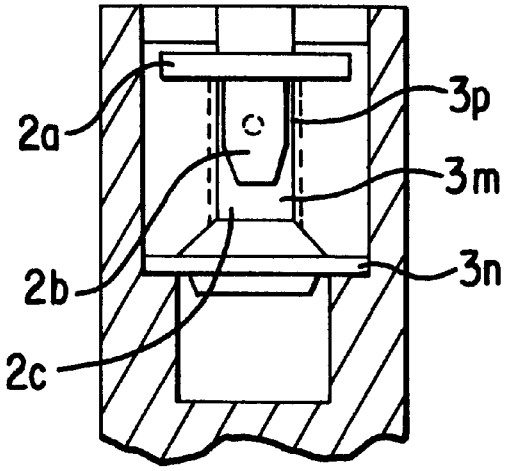

FIGS. 6(*a*) and 6(*b*) are cross sectional views of a main part of the terminal device in the condition in which the terminal screw is retained as shown in FIG. 5(*a*). FIG. 6(*a*) shows the inverse L-shaped washer with the male screw 2*n* inserted into the guide groove, and FIG. 6(*b*) shows only the inverse L-shaped washer inserted into the guide groove. In FIG. 6(*b*), the side portions of the thin portion 2*c* are inserted into the vertical groove of the guide groove 3*m*, while the side portions of the thick portion 2*b* are restricted by the guide wall 3*p*. Thus, the male screw 2*n* does not substantially move in the lateral direction and front and back directions, and the male screw 2*n* can be pressed down exactly vertically, so that the tip of the male screw 2*n* can be reliably guided to the tapped hole in the fixed terminal 3*n*.

Figure 7A:
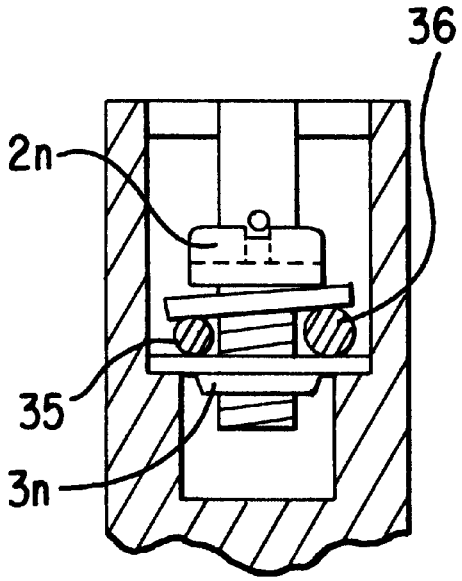
FIGS. 7(*a*) and 7(*b*) are cross sectional views showing a main part of the terminal device when electric wires with different diameters are fixed on both sides of the screw, wherein FIG. 7(*a*) shows that the inverse L-shaped washer with the male screw is inserted.
Figure 7B:
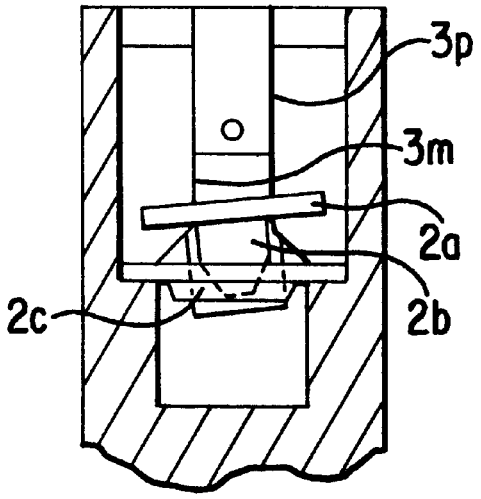

FIGS. 7(*a*) and 7(*b*) are cross sectional views showing a main part of the terminal device according to the invention, and also showing that tightening has been completed with electric wires of different diameters connected in parallel on both sides of the male screw. FIG. 7(*a*) shows the inverse L-shaped washer with the male screw inserted into the fixed terminal 3*n*, and FIG. 7(*b*) shows only the inverse L-shaped washer inserted into the fixed terminal 3*n*.

In these figures, when a thin wire 35 and a thick wire 36 are inserted on both sides of the male screw 2*n* and the terminal screw is then pressed down, the guide plate section of the inverse L-shaped washer 2*a* is released from guiding the guide groove 3*m*, and the horizontal portion of the inverse L-shaped washer 2*a* is inclined and stabilized at a position where its bottom surface contacts both wires 35 and 36 of the different diameters, as shown in FIG. 7(*b*). This is because the guide groove 3*m* is shaped in such a way that the guide wall 3*p* is inversely tapered or opened widely in the downward direction so as to prevent both sides of the thick portion 2*b* of the guide plate section from contacting the guide wall 3*p*, and that a space is formed in a part of the inside of the vertical groove of the guide groove 3*m* at the lower part of the guide wall to prevent both sides of the thin portion 2*c* of the guide plate section from contacting the side edges of the guide groove 3*m*.

Although the above embodiment has been described in conjunction with the connection of the two wires with different diameters, a single wire can also be reliably connected and fixed because the inverse L-shaped washer 2*a* is inclined.

Figure 8A:
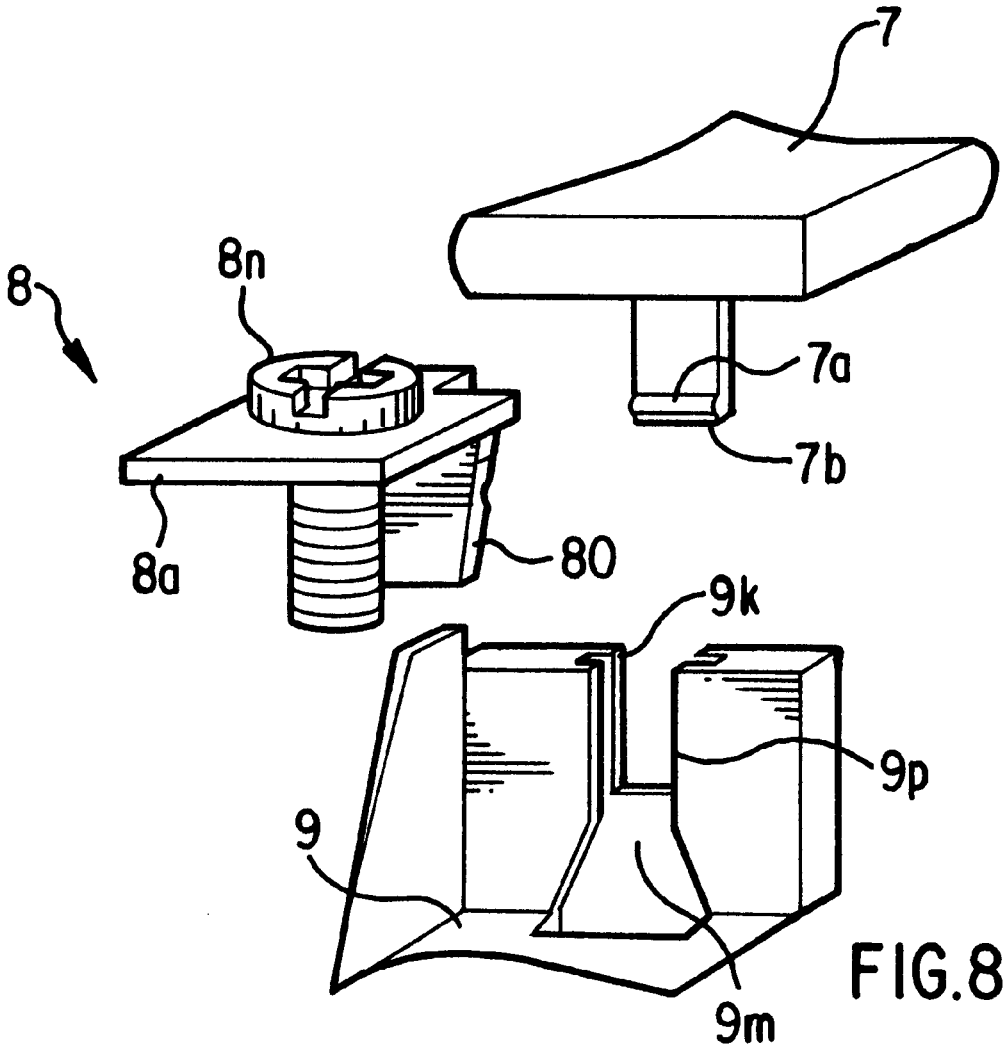
FIG. 8(*a*) is an exploded perspective view showing a terminal device of another embodiment of the invention.
Figure 8B:
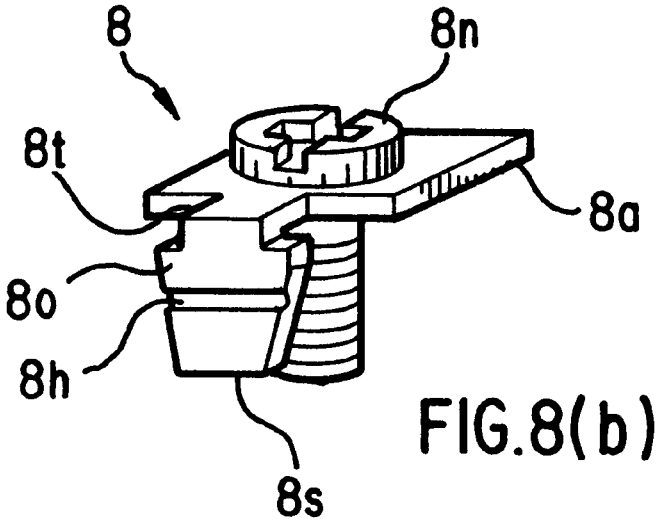
Figure 9:
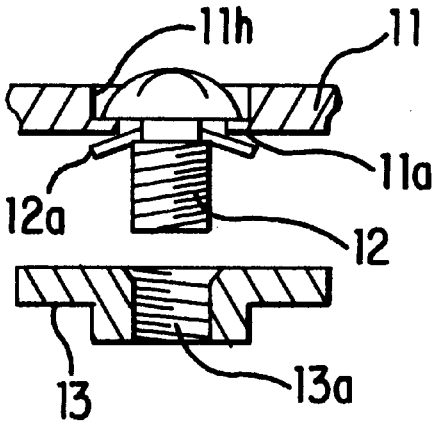
FIG. 9 PRIOR ART
FIG. 9 is an explanatory sectional view of a conventional terminal device.
Figure 10:
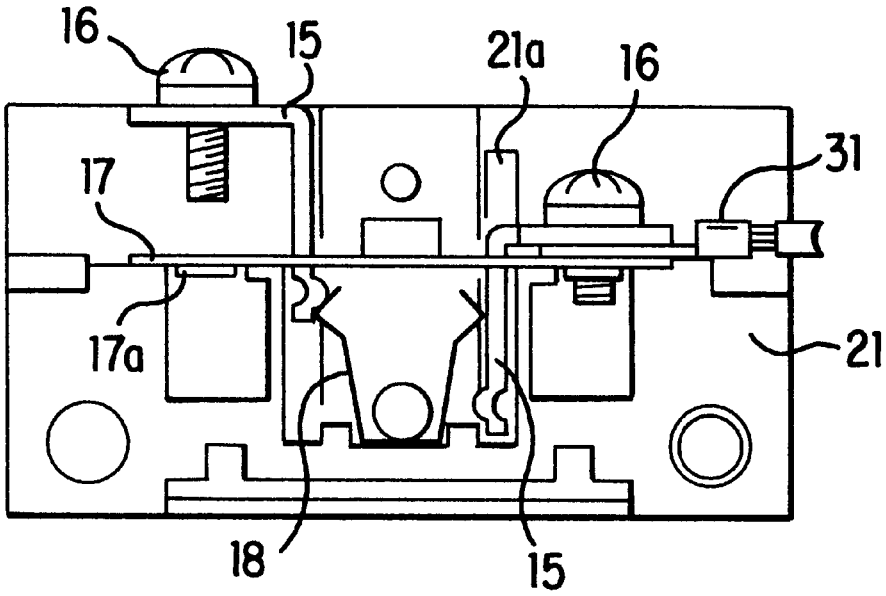
FIG. 10 PRIOR ART
FIG. 10 is a front view showing a main part of another conventional terminal device.
Figure 11A:
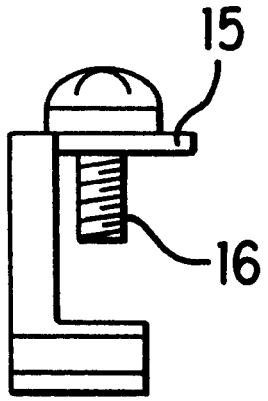
FIG.11(a) PRIOR ART
FIG. 11(*a*) is a front view showing a shape of a terminal screw in FIG. 10.
Figure 11B:
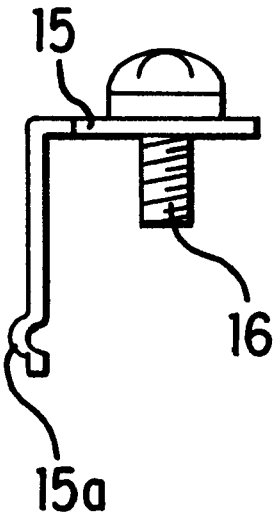
FIG.11(b) PRIOR ART

FIGS. 8(*a*) and 8(*b*) show another embodiment of this invention. FIG. 8(*a*) is an exploded perspective view showing a terminal device, and FIG. 8(*b*) is a partial perspective view of a terminal screw 8. In these figures, a terminal device according to the invention comprises the terminal screw 8 with an inverse L-shaped washer 8*a* including a guide plate section 80, whose tip is formed as a narrow portion 8*s*, having an engagement section formed as a recessed groove 8*h*; a cover 7 with a protruding portion 7*a* that is an engagement section formed on a flexible piece 7*b* and engaged with the recessed groove 8*h*; a guide groove 9*m* including a vertical groove for guiding the thickness and width directions of the guide plate section 80 and a guide wall 9*p* for guiding a slender neck part 8*t* of the inverse L-shaped washer 8*a*; and a terminal housing section 9 with a notch 9*k* in which the flexible piece 7*b* is fitted. In the guide groove 9*m*, a lower part of the guide wall 9*p* is inversely tapered or opened widely in the lower direction, and a space wider than the guide plate section 80 is formed in a part of the inside of the vertical groove in the lower part of the guide wall 9*p* to stop guiding of the guide plate section 80 at a position where the wires are pressed under the inverse L-shaped washer. The other structure is similar to that of the first embodiment, so that its description is omitted.

In this structure, the flexible piece 7*b* of the cover 7 is fitted in the notch 9*k* in the terminal housing section 9, so that the protruding portion 7*a* of the flexible piece 7*b* is positioned inside the guide groove 9*m*. Then, when the guide plate section 80 of the inverse L-shaped washer 8*a* of the terminal screw 8 is inserted into the guide groove 9*m* in the terminal housing section 9 from above, the recessed groove 8*h* in the guide plate section 80 is fitted with the protruding portion 7*a* of the flexible piece. Thus, a gap is maintained between the tip of the male screw 8*n* and the fixed terminal (not shown), as in the first embodiment, which is shown in FIG. 4.

In addition, since the inverse L-shaped washer is formed such that the guidance of the guide plate section 80 through the guide groove 9*m* is released or stopped at a position where the wires are pressed under the inverse L-shaped washer, the wires with different diameters can be reliably pressed on both sides of the male screw, as shown in FIG. 7(*a*). In this embodiment, the guide wall 9*p* has almost the same width as the slender neck part 8*t* of the inverse L-shaped washer and the lower part of the guide wall 9*p* is inversely tapered. However, the taper shape may be eliminated to simplify the shape of the guide groove by increasing the width of the guide wall 9*p* as compared to the slender neck part 8*t* in order to prevent the slender neck part 8*t* from contacting the guide wall 9*p* at both sides thereof when the inverse L-shaped washer is inclined.

According to this invention, in the condition that the guide plate section of the inverse L-shaped washer is guided along the guide groove, the terminal screw can be held to have a constant gap between the tip of the male screw and the fixed terminal. This structure prevents the terminal screw from slipping out or getting lost and enables the male screw of the terminal screw to be reliably guided to the tapped hole in the fixed terminal. Furthermore, the inverse L-shaped washer can be inclined to a position at which the wiring is pressed, so that the wires with the different diameters or a single wire can be firmly fixed on one or both sides of the screw.

What is claimed is:

1. A terminal device for an electric equipment, comprising:

a frame having a terminal housing, a fixed terminal situated in the terminal housing and having a tapped hole, a terminal screw including a male screw having a tip portion to be coupled to the tapped hole, and an inverse L-shaped washer having one side for rotatably holding the male screw and a guide plate section bent relative to the one side to have an inverse L-shape, said guide plate section having a thick portion in a middle of the guide plate section and a thin portion at two sides of the thick portion, a guide groove formed in the terminal housing for receiving the guide plate section of the inverse L-shaped washer therein to vertically guide the guide plate section, said guide groove having a vertical groove for guiding the thin portion in a thickness direction and a guide wall for guiding the thick portion in a width direction, and means to release guiding of the guide plate section when the tip portion of the male screw is coupled to the fixed terminal, and an engagement section having a first engaging part formed on the guide plate section of the inverse L-shaped washer and a second engaging part formed at a portion facing the guide groove and engaging the first engaging part to temporarily hold the guide plate section in the guide groove so that a gap is maintained between the tip portion of the male screw and the fixed terminal.

2. A terminal device for an electric equipment according to claim 1, wherein said guide groove is formed of a vertical groove for guiding the guide plate section in the thickness and width directions thereof.

3. A terminal device for an electric equipment according to claim 2, wherein said guide groove includes a wide portion opening downwardly to constitute said means to release guiding of the guide plate section.

4. A terminal device for an electric equipment according to claim 1, wherein said frame includes an insulation wall for dividing the terminal housing into spaces, said fixed terminal and terminal screw being located in each space.

5. A terminal device for an electric equipment, comprising:

a frame having a terminal housing with a notch, a fixed terminal situated in the terminal housing and having a tapped hole, a terminal screw including a male screw having a tip portion to be coupled to the tapped hole, and an inverse L-shaped washer having one side for rotatably holding the male screw and a guide plate section bent relative to the one side to have an inverse L-shape, a guide groove formed in the terminal housing and facing the notch for receiving the guide plate section of the inverse L-shaped washer in the guide groove to vertically guide the guide plate section, said guide groove having means to release guiding of the guide plate section when the tip portion of the male screw is coupled to the fixed terminal, an engagement section having a first engaging part formed on the guide plate section of the inverse L-shaped washer and a second engaging part formed at a portion facing the guide groove and engaging the first engaging part to temporarily hold the guide plate section in the guide groove so that a gap is maintained between the tip portion of the male screw and the fixed terminal, and a flexible piece fitted in the notch of the terminal housing and having the second engaging part to engage the first engaging part.

6. A terminal device for an electric equipment according to claim 5, further comprising a cover to be mounted on the frame and having said flexible piece.

* * * * *